US006250886B1

(12) United States Patent
Immell et al.

(10) Patent No.: US 6,250,886 B1
(45) Date of Patent: Jun. 26, 2001

(54) AXIAL FLOW FAN AND FAN BLADE

(75) Inventors: William F. Immell, Tulsa; Sean D. Scott, Broken Arrow; John W. Van Atta, Tulsa, all of OK (US)

(73) Assignee: Chittom International, Inc., Tulsa, OK (US)

( * ) Notice: Subject to any disclaimer, the term of this patent is extended or adjusted under 35 U.S.C. 154(b) by 0 days.

(21) Appl. No.: 09/389,929

(22) Filed: Sep. 3, 1999

(51) Int. Cl.[7] ..... F04D 29/34

(52) U.S. Cl. ..... 416/214 R; 416/232; 416/239; 416/219 A

(58) Field of Search ..... 416/219 A, 220 A, 416/226, 224, 210 R, 232, 239, 214 R; 29/889.3, 889.72

(56) References Cited

U.S. PATENT DOCUMENTS

| | | | | |
|---|---|---|---|---|
| Re. 34,207 | | 3/1993 | Nelson et al. . | |
| D. 265,502 | | 7/1982 | Kearnes . | |
| 1,404,298 | | 1/1922 | Jacobs . | |
| 1,912,979 | | 6/1933 | Havill . | |
| 2,395,193 | | 2/1946 | Place . | |
| 2,511,862 | * | 6/1950 | MArtin | 416/226 |
| 2,623,599 | | 12/1952 | Kearns, Jr. . | |
| 2,682,925 | | 7/1954 | Wosika | 170/159 |
| 2,814,350 | | 11/1957 | Nelson | 170/159 |
| 2,918,977 | | 12/1959 | Fedan et al. . | |
| 3,628,888 | | 12/1971 | Wooden . | |
| 3,799,701 | | 3/1974 | Rothman . | |
| 3,891,349 | | 6/1975 | Woollenweber, Jr. . | |
| 4,345,877 | | 8/1982 | Monroe . | |
| 4,618,313 | | 10/1986 | Mosiewicz . | |
| 4,636,142 | | 1/1987 | Baranski . | |
| 4,720,244 | * | 1/1988 | Kluppel et al. | 416/224 |
| 5,035,576 | * | 7/1991 | Byrnes et al. | 416/134 R |
| 5,222,297 | * | 6/1993 | Graff et al. | 29/889.71 |
| 6,022,191 | * | 2/2000 | Moore et al. | 419/134 R |

FOREIGN PATENT DOCUMENTS

| | | |
|---|---|---|
| 1037057 | 8/1958 | (DE) . |
| 2242218 | 9/1973 | (DE) . |
| 1267976 | 5/1963 | (FR) . |
| 60-30500 | 2/1985 | (JP) . |
| 224357 | 11/1924 | (NZ) . |

* cited by examiner

*Primary Examiner*—Edward K. Look
*Assistant Examiner*—Ninh Nguyen
(74) *Attorney, Agent, or Firm*—Fellers, Snider, Blankenship, Bailey & Tippens, P.C.

(57) ABSTRACT

The present invention provides an axial flow fan and fan blade. A true tapered, twisted airfoil section is constructed by cutting a flat piece of light alloy to a unique shape to obtain a flat pattern representative of a selected airfoil design, forming the airfoil section by making three simple bends in the pattern and joining the trailing edge with rivets. A transition piece is provided to connect the airfoil section to the fan hub. The transition piece has first and second airfoil bearing surfaces, substantially all of which are in contact with the interior surface of the airfoil section and which possess a twist complementary to the twist of the airfoil section. The transition is substantially flat and is preferably of a two piece design comprising juxtaposed first and second pieces joined along a peripheral flange. The transition piece allows for the use of a generally U-shaped rivet pattern for the mechanical connection between the airfoil section and the transition.

24 Claims, 7 Drawing Sheets

AXIAL FLOW FAN AND FAN BLADE

BACKGROUND OF THE INVENTION

1. Field of the Invention

This invention relates generally to axial flow fan and blade assemblies, and, more specifically, to large, industrial-type axial flow fans and improvements in the construction of blades therefor.

2. Background

It is generally preferable to use true tapered, twisted fan blades to achieve maximum air displacement efficiencies in large fan assemblies. It is also preferable to use lower cost fabricated light alloy fan blades in place of much more expensive molded fiberglass blades. But because of certain manufacturing complexities it has been practically impossible to reach suitable twist values in alloy fan blade airfoils without causing damage to the blade itself. One response to this limitation has been to add a tab to the trailing edge of an untwisted alloy fan blade in order to simulate the effects of a true twisted blade. Though this approach increases the effective displacement of air of an untwisted blade, a true twisted airfoil is still more efficient and desirable than the simulated effects of a modified trailing edge.

It is thus an object of this invention to provide an axial flow fan of the type described having blades fabricated from light alloy with a true twisted configuration to achieve maximum aerodynamic performance.

In connection with large, high performance fans it is also necessary to manage the stresses from aerodynamic loading generated in the airfoil skin. Heretofore fans of this type have utilized a relatively narrow cast, formed or fabricated transition piece from the fan hub to the airfoil section of the blade that limits the means of attachment to the airfoil skin and tends to concentrate stresses from the aerodynamic loading.

It is accordingly a further object of the invention to provide a axial fan having a transition from the fan hub to the airfoil section of the fan blade that not only allows for the use of a true twisted airfoil but also provides a mechanical joint between the airfoil skin and the transition piece which has a lower stress concentration pattern to better distribute aerodynamic loading forces.

SUMMARY OF THE INVENTION

These and other objects and advantages are achieved in the present invention wherein a true tapered, twisted airfoil section is constructed by cutting a flat piece of light alloy to a unique shape to obtain a flat pattern representative of a selected airfoil design, forming the airfoil section by making three simple bends in the pattern and joining the trailing edge with rivets or by other means. The required shape is obtained by "unfolding" a desired airfoil design into a representative pattern that is preferably laser cut from flat alloy stock.

The bending process does not result in any appreciable reduction of thickness in the formed airfoil skin, as is the case with conventional stretch forming processes, and requires simpler and less expensive tooling. The airfoil section is formed by making first and second bends of opposite directions to curve the long edges of a flat, generally flag-shaped quadrilateral airfoil skin, making a third bend at a dissecting line to form the leading edge, and then joining the long edges of the skin to form the trailing edge of the airfoil section.

In another aspect of the invention a transition piece is provided to connect the airfoil section to the fan hub. The transition piece has first and second airfoil bearing surfaces, substantially all of which are in contact with the interior surface of the airfoil section and which possess a twist complementary to the twist of the airfoil section. The transition is substantially flat and is preferably of a two piece design comprising juxtaposed first and second pieces joined along a peripheral flange. The airfoil bearing surface of each piece matches the curvature of the portion of the interior surface of the airfoil section it contacts.

In a further aspect of the invention, the transition piece allows for the use of a unique, generally U-shaped rivet pattern for the mechanical connection between the airfoil section and the transition which has significantly lower stress concentration patterns than previous parallel, perpendicular or zig-zag patterns of attachment.

In accordance with the preferred embodiment of the invention both the airfoil section and transition piece are constructed of aluminum so as to provide a lightweight, inexpensive fan blade. It is also preferred that the airfoil section be tapered from its root end to its tip so as to form, when constructed, a true tapered, twisted airfoil.

A better understanding of the present invention, its several aspects, and its objects and advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Figure 1:
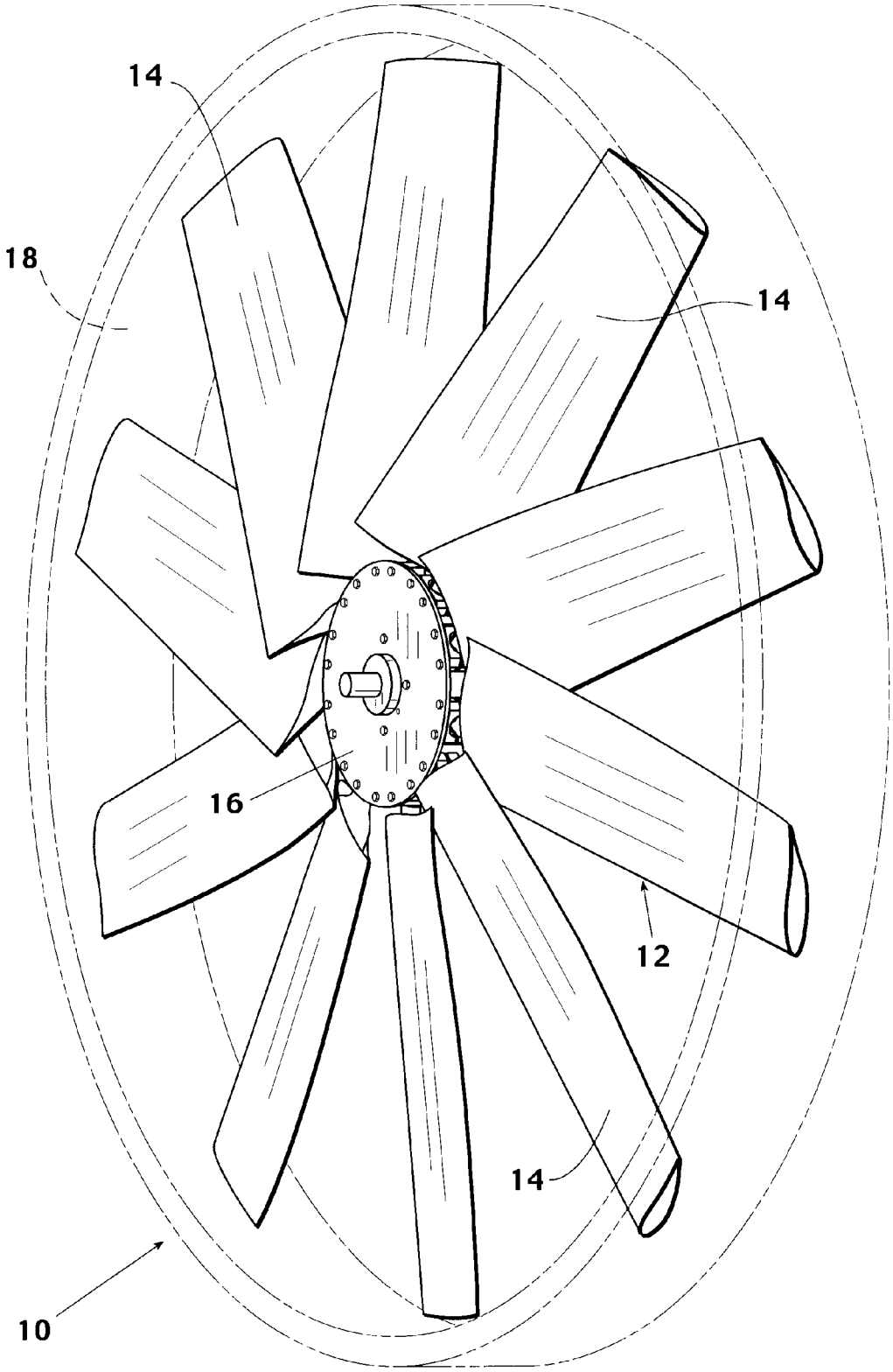
FIG. 1 is a perspective view of an axial flow fan constructed in accordance with the preferred embodiment of the present invention.
Figure 2:
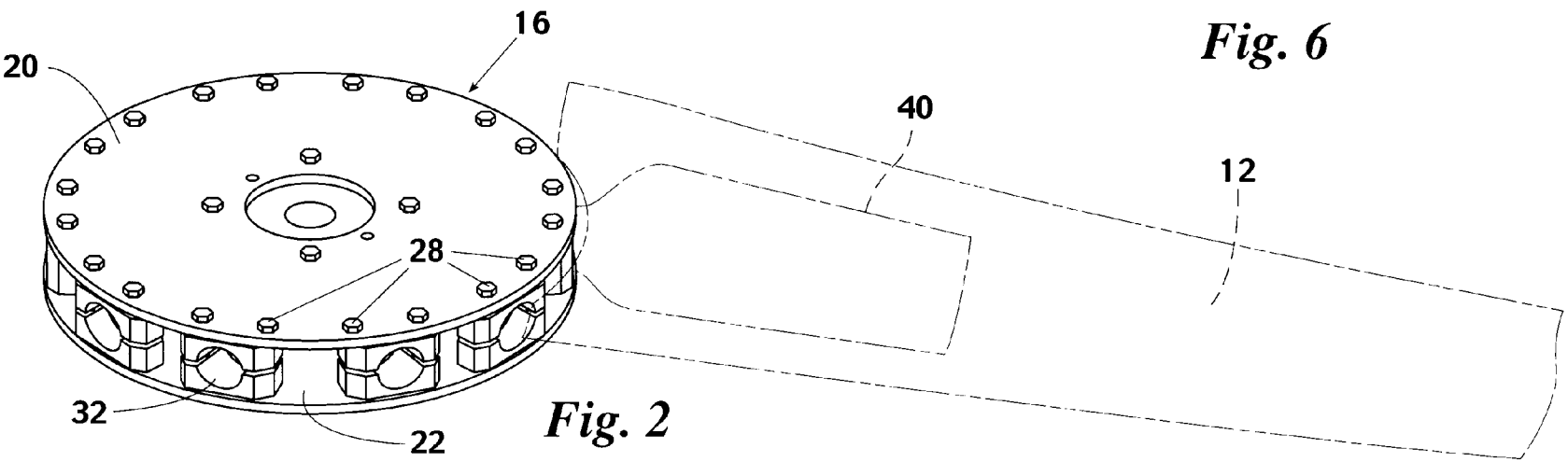
FIG. 2 is a perspective view of a fan hub and shows in phantom the preferred fan blade.
Figure 3:
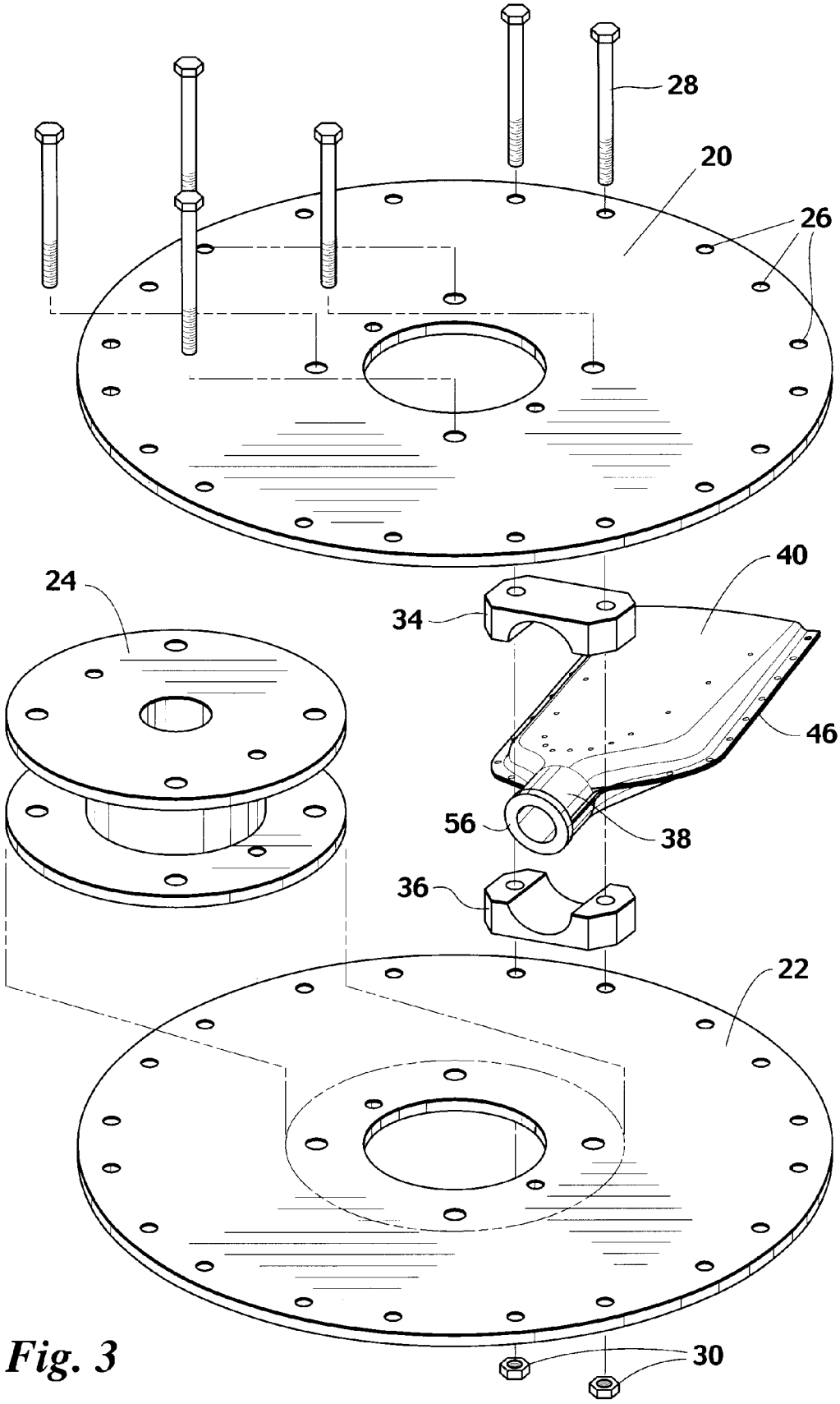
FIG. 3 is an exploded view of the fan hub of FIG. 2 and shows the interrelation of the preferred transition piece to the fan hub.

Referring now to the drawings, wherein like reference numerals designate identical or corresponding parts throughout the several views, and initially to FIGS. 1–3, there is shown a fan assembly 10 of the axial fan type wherein a plurality of blades 12, each possessing an airfoil section 14, are connected to and extend radially away from a hub 16. The fan assembly 10 is generally contained for use within a shroud, indicated in phantom lines in FIG. 1 by the reference numeral 18.

Figure 4:
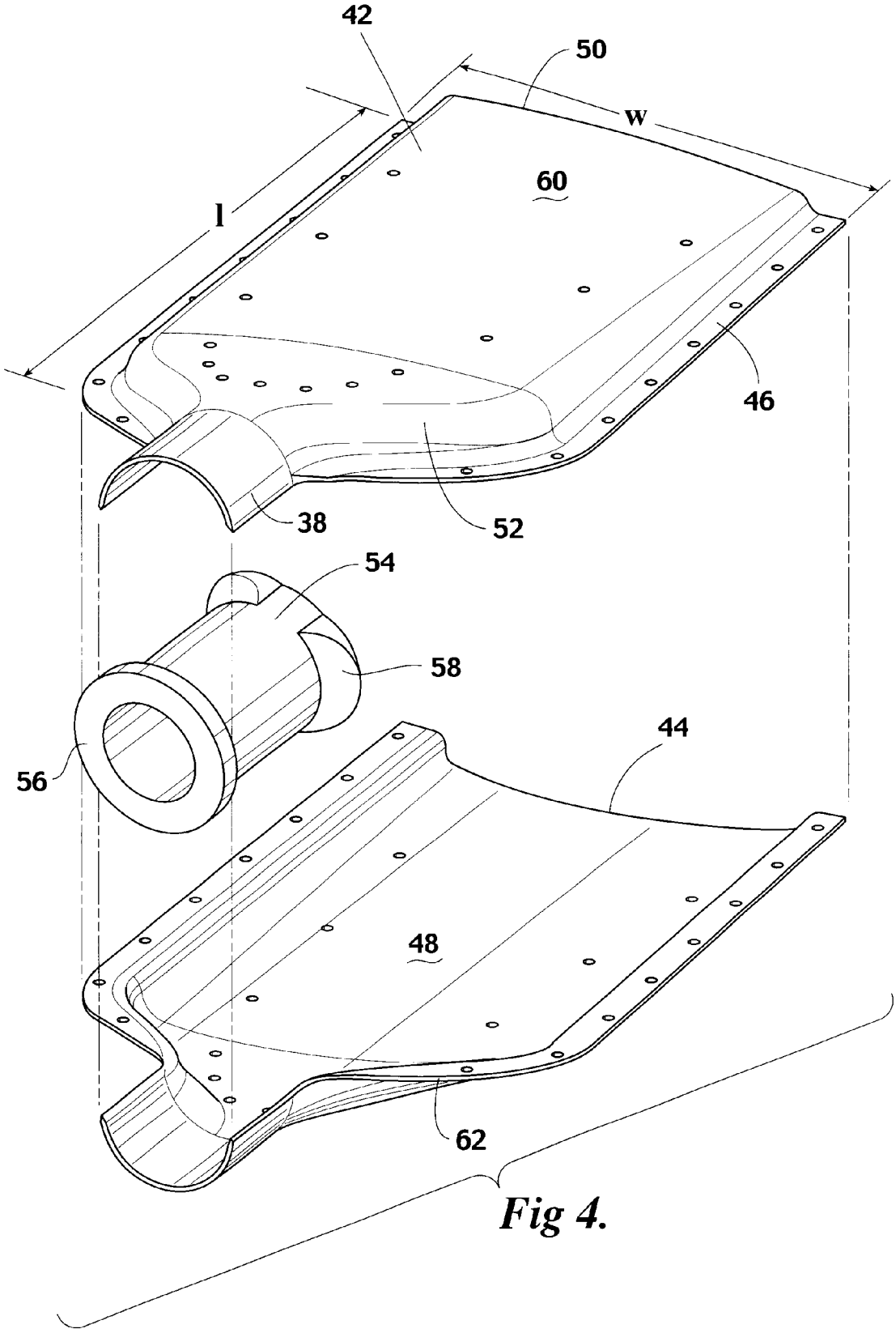
FIG. 4 is an exploded view of the preferred transition piece.
Figure 5:
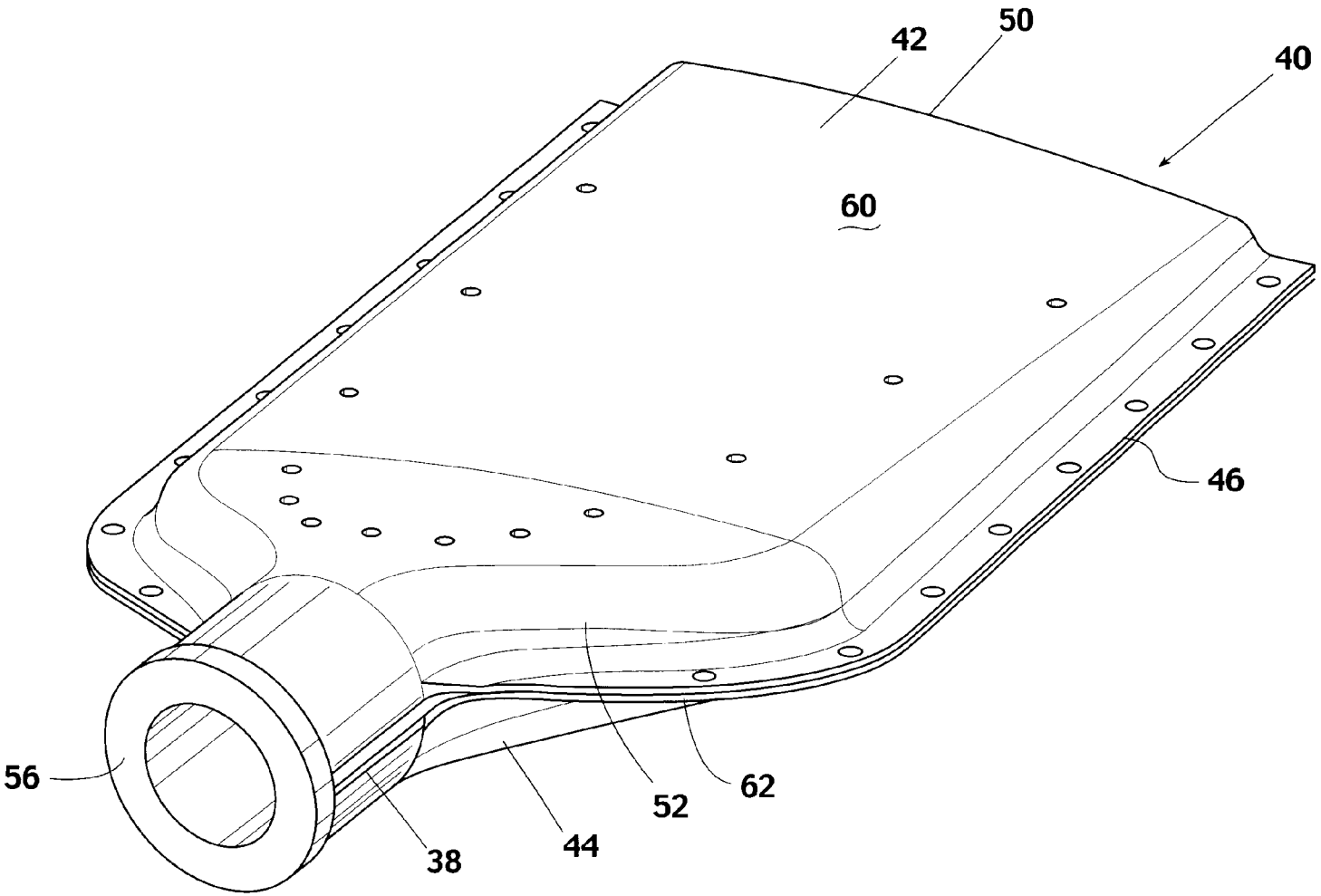
FIG. 5 is a perspective view of the preferred transition.

Referring now more particularly to FIGS. 2 and 3, the preferred hub 16 includes a first plate 20 fixed in a spaced relationship parallel to a like second plate 22 by a hub center 24. The plates 20, 22 and hub center 24 are provided with a plurality of through-holes 26 for the passing of bolts 28 so that the hub 16 may be tightly secured with nuts 30. The periphery of each plate 20, 22 is also possessed with pairs of through-holes for mating with a plurality of two-piece blade clamps 32. A first portion 34 of the blade clamp 32 is set to the underside of the first plate 20 while a second portion 36 of the blade clamp 32 is operatively disposed atop the second plate 22. The facing surfaces of each portion 34, 36 of the blade clamp 32 are recessed so as to receive and secure the neck 38 of a transition piece 40. The transition piece 40 is best shown in FIG. 4, to which attention is now directed.

The transition piece 40 (sometimes referred to simply as the "transition"), connects the airfoil section 14 of the fan blade 12 to the hub 16. It is preferably of a two-piece design wherein first and second pieces 42, 44 are joined by rivets along a peripheral flange 46. Each piece 42, 44 is stamped out of flat alloy stock, preferably aluminum, to achieve the illustrated form which consists of a shallow dished or recessed interior surface 48, a generally straight tip end 50 and a root end 52 having a semicircular neck portion 38 extending therefrom. A collar 54 having proximal and distal flanges, reference elements 56 and 58 respectively, is placed within the neck portion 38 of the transition piece 40 to provide a holding surface for the blade clamp 32 and prevent axial separation of the transition piece 40 from the hub 16.

As thus described, when the first and second pieces 42, 44 are joined by rivets along the peripheral flange 46 there is obtained a lightweight, hollow transition piece 40 having raised, airfoil bearing surfaces 60, 62 which contact the inner surfaces of the airfoil section 14 of the fan blade 12 and serve as a joint therefor. As compared to the beam-like construction of conventional transition elements, the transition piece 40 of the present invention is relatively wide. The shape of the preferred inventive transition 40 may be described as generally rectangular wherein the root end 52 is provided with a sloping shoulder 53 that narrows into the neck portion 38 and wherein the transition length l is 1.5–3.0 times the transition width w and most preferably l=2w. The transition width w is generally in a range of 30–70% of the width of the airfoil section 14. The length of the airfoil section is generally 1.5–6.0 times the length of the transition 40 as the same transition may be used with various sizes of industrial fan blades. The transition 40 is preferably tapered to a degree substantially the same as the taper of the airfoil section 14 to provide clearance for the peripheral flange 46 of the transition 40.

The unique shape of the transition 40 allows the airfoil bearing surfaces 60, 62 to each be provided with a pattern for rivets having a significantly lower stress concentration value than the previous parallel, perpendicular or zig-zag patterns of attachment. One such preferred pattern, as illustrated in the drawings, is a generally U-shaped design. In the most preferred pattern the base of the rivet pattern (i.e. the bottom of the U) is adjacent the hub 16 of the fan assembly 10 and the space between successive rivets is generally progressively reduced toward the base of the rivet pattern. The term "generally" is used here as sometimes it is necessary to space the terminal tip end pair of rivets closer to the preceding pair. This joint design has shown to provide a much better stress resistance than previous designs used in connection with conventional axial flow fan blades.

Figure 6:
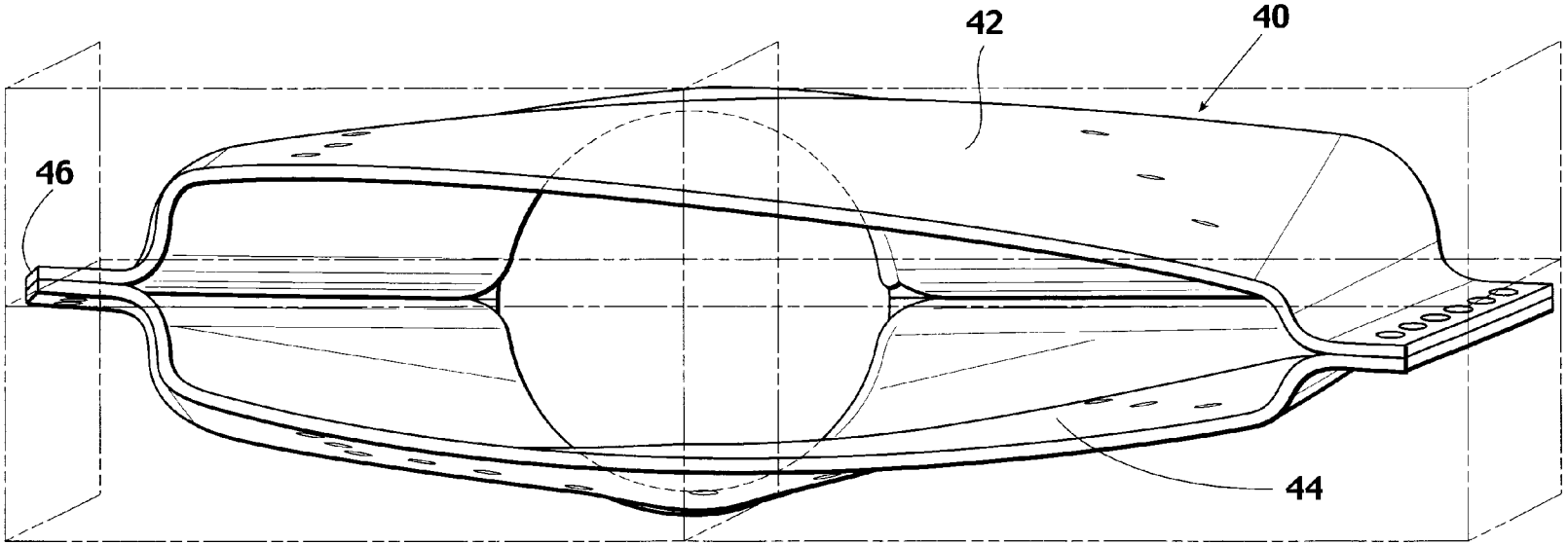
FIG. 6 is an end view taken from the tip of the transition piece and includes reference planes to illustrate the twisted configuration of the transition piece.

Because it transmits higher loads as compared to previous transitions, the inventive transition 40 also allows for the utilization of a fabricated light alloy blade having a true tapered, twisted airfoil. In another aspect of the invention, the transition 40 is itself twisted in a complementary fashion to the airfoil section 14 such that substantially all of the first and second airfoil bearing surfaces 60, 62 are in contact with the interior surfaces of the airfoil section 14, thus providing the greatest possible stress and load distribution. Illustrative of this aspect of the invention is FIG. 6 wherein reference planes are shown in phantom to illustrate the aforedescribed twist of the transition 40. The twist is imparted to the transition 40 by the stamping the desired twist into each of the first and second transition pieces 42, 44.

Figure 7:
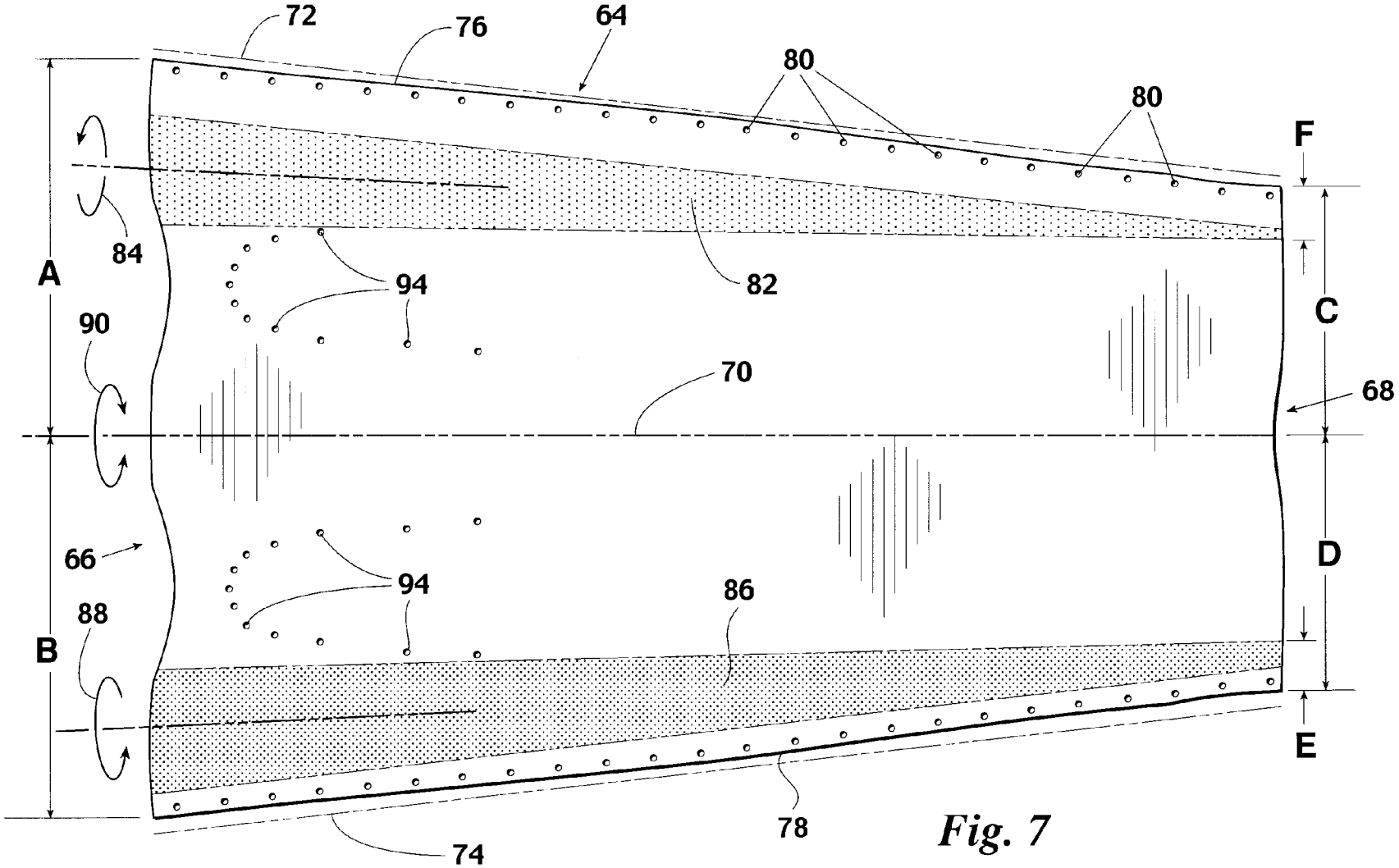
FIG. 7 is a plan view of a flat alloy pattern used to form the airfoil section of the preferred blade and includes reference lines to illustrate features of the pattern.
Figure 8:
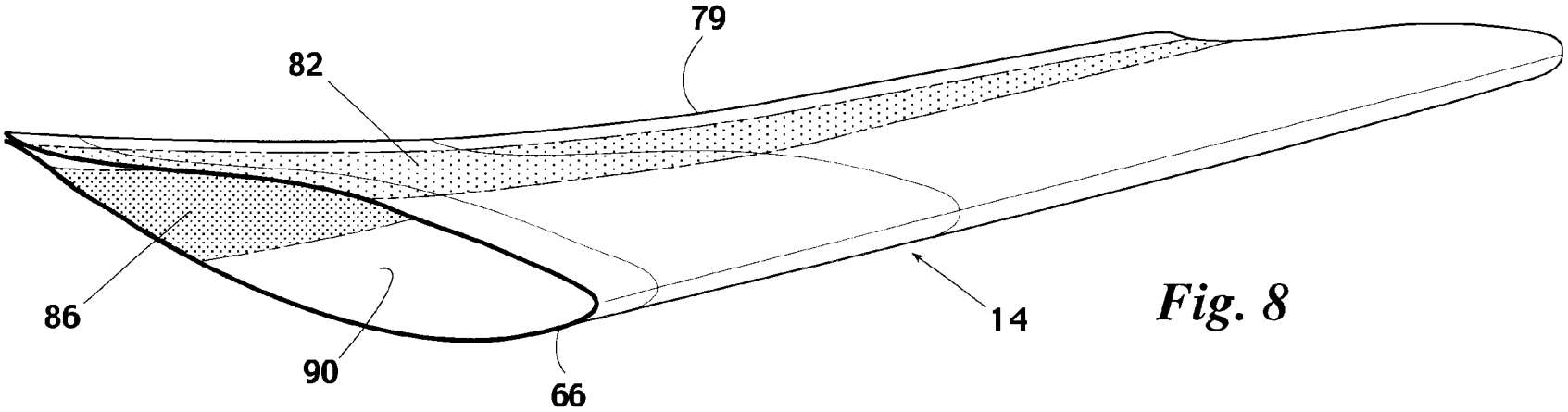
FIG. 8 is a perspective view of the airfoil section of the preferred blade after the pattern of FIG. 5 has been bent and the trailing edges joined.
Figure 9:
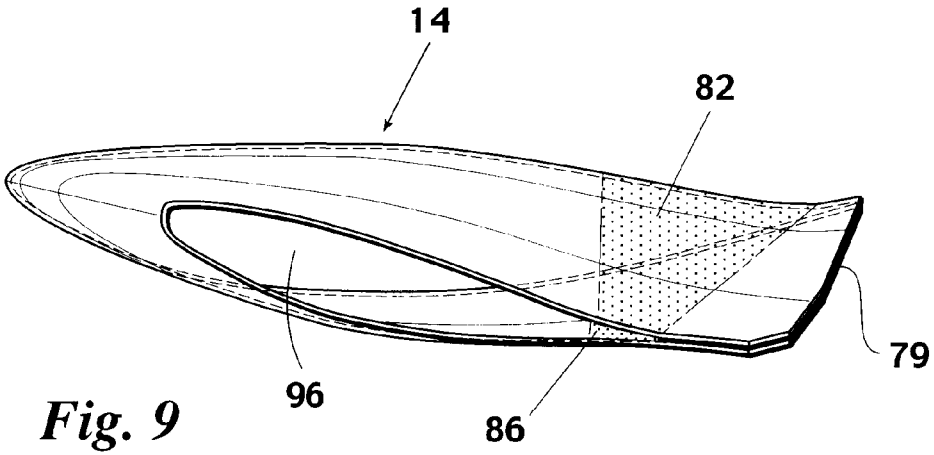
FIG. 9 is an end view taken from the tip of the airfoil section of the preferred fan blade.

Described now in connection with FIGS. 7–9 is the preferred airfoil section 14 and its method of manufacture.

The inventive fan blade 12 preferably utilizes a true tapered, twisted airfoil section 14 that is constructed by cutting a piece of flat alloy stock to shape to obtain a flat pattern (i.e. skin) that allows for the forming of the airfoil section 14 by making three simple bends in the skin and joining the trailing edge with rivets or by other conventional means such as welding or other bonding. The preferred alloy is aluminum, however, stainless steel, galvanized steel and other known alloys might be utilized. It is also contemplated that plastic composite sheets might be used in the construction of airfoil section, however, such would require that the sheets be heated and formed to the desired shape rather than using the simple bending process described hereinbelow.

An example of a pattern representative of a selected airfoil design is illustrated in FIG. 7 as element 64 wherein the root end 66 of what will be the airfoil section 14 is at the left of the drawing while the tip 68 is at the right. The pattern 64 is a generally flag-shaped quadrilateral, tapering from the root end 66 to the tip 68. Dotted reference lines and shaded areas are shown in the drawing for explanatory purposes. The middle reference line, identified by the reference numeral 70, defines what will be the leading edge of the airfoil section 14. The two outermost reference lines, demarcated lines 72 and 74, lie immediately adjacent to the long edges 76, 78 (also the "trailing" edges) of the pattern 64 and are shown to illustrate the continuously curved nature of these edges which account in part for the twist imparted to the airfoil as will be described. The edges 76, 78 are provided with opposed and complementary through-holes 80 for receiving rivets. The two shaded triangular areas denote bend areas.

The required shape of the pattern 64 necessary to achieve a desired airfoil design is generated by "unfolding" a selected airfoil design to obtain a two-dimensional pattern representative of the design. The selection of the airfoil design may be made from well known, generally available reference databases containing NACA (National Advisory Committee for Aeronautics) airfoil coordinates for designs meeting desired performance and engineering criteria. The University of Illinois at Urbana-Champaign also maintains an airfoil data site on the World Wide Web containing an airfoil coordinates database and links to similar generally available sources.

Once a desired airfoil design is selected, the design is reduced to a two-dimensional flat pattern representative of the selected design. This is accomplished by determining a value for, or indicative of, the perimeter (i.e. circumference) of the airfoil surface at a plurality of cross-sections taken incrementally along the length of the airfoil, plotting the values and fitting a line from point to point to define the outer margins of the pattern. The line is smoothed so that it typically generates a border having a continuously changing curvature as is illustrated by the two outermost reference lines 72 and 74 of FIG. 7. This step of generating a two-dimensional flat pattern representative of the selected design may be accomplished by hand, e.g. by physically measuring the circumference of a model airfoil at numerous points along the length of the airfoil, or using computer-aided design techniques to automate this "unfolding" procedure as may be accomplished by those skilled in the art.

The airfoil section 14 is formed by making first and second bends of opposite directions to curve the long edges 76, 78 of the pattern 64, making a third bend at line 70 to form the leading edge, and then joining the long edges 76, 78 of the pattern 64 to form the trailing edge of the airfoil section 14. In the most preferred embodiment of the invention, the depth and width of the first and second bends 82, 86 increase toward the root end 66 of the pattern 64 to impart a deeper and wider bend at the root end 66. The radius of the first and second bends 82, 86 may be the same or different depending upon the characteristics of the selected airfoil design. The curvature at one side of the pattern 64 is generally wider than the other to facilitate the formation of the desired twist. The amount of bend and the exact placement of the bends are empirically determined based upon the specifications of the airfoil material utilized and the selected design, and it is often necessary to overbend the pattern 64 slightly to adjust for springback of material to achieve the desired shape in the first and second bends 82, 86.

By specific example, and with reference to FIG. 7, a true tapered, twisted airfoil section is obtained by making in the example pattern 64 (1) a first bend, such as indicated by the lower density shaded area 82, in an upward direction as indicated by arrow 84, (2) a second bend, such as indicated by the higher density shaded area 86, in a downward direction as indicated by arrow 88, a third bend at line 70 in a downward direction as indicated by double-headed arrow 90, and joining the edges 76, 78 of the pattern 64 such as, by way of example, a plurality of rivets secured in holes 80 along the edges 76, 78 of the skin. The bends are made in conventional fashion such as with a radiused die.

Still with respect to FIG. 7, the twisted configuration of the airfoil section 14 is achieved by virtue of the shape of the pattern 64 and the provision of the aforedescribed bends. As is indicated in the drawing, bend line 70 dissects the pattern 64 from its root end 66 to its tip 68. To achieve the desired twisted configuration, the pattern is dimensioned such that the indicated distances A–E bear the following relationships: A<B; C<D; and E<F, where:

A=root end distance from bend line 70 to edge 76;

B=root end distance from bend line 70 to edge 78;

C=tip end distance from bend line 70 to edge 76;

D=tip end distance from bend line 70 to edge 78;

E=distance from edge 76 to the far side of bend 82; and

F=distance from edge 78 to the far side of bend 86.

It should be noted, however, that the blade can be made either of a left hand or right hand rotation by reversing the directions of the bends, rendering an opposite twist. Again, the precise location of the bends required to achieve a desired airfoil configuration is readily determined empirically.

FIGS. 8 and 9 show perspective views of the preferred airfoil section 14 after edges 76, 78 of the pattern 64 (FIG. 7) have been joined to form the trailing edge 79. As is seen, the airfoil section 14 is of a true, twisted tapered form. After the bending operation the root end 66 of the airfoil section 14 defines an opening 92 into which the assembled transition piece is inserted. In another preferred aspect of the invention, through-holes 94 (FIG. 7) complementary in position to those of the transition piece are laser cut into the blank pattern 64 prior to the bending operation so that once the transition piece is inserted the two components may be readily joined. The tip 68 of the airfoil section also defines an opening 96 into which a cap (not shown) of a like shape is affixed.

A plurality of the inventive fan blades are joined to a hub to form a novel axial flow fan.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

What is claimed is:

1. An axial flow fan, comprising:

a hub;

a plurality of hollow airfoil sections, each comprising a sheet of alloy bent to form a leading edge and having a trailing edge formed from the joining of two long edges of the sheet, each of the long edges having a substantially continuously changing curvature, the sheet possessing a bend of a first direction adjacent one of the two long edges and a bend of a second direction adjacent the other of the two long edges, whereby each of the airfoil sections possesses a twist; and for each airfoil section, a transition piece connecting the airfoil section to the hub, the transition piece have first and second airfoil bearing surfaces, substantially all of the bearing surfaces being in contact with an interior surface of the airfoil section, and wherein each of the bearing surfaces after joining to the airfoil section possesses a twist complementary to the twist of the airfoil section.

2. The axial flow fan of claim 1 wherein the alloy is aluminum.

3. The axial flow fan of claim 1 wherein each of the airfoil sections is tapered.

4. The axial flow fan of claim 1 wherein the airfoil sections and the transition pieces are aluminum.

5. The axial flow fan of claim 1 wherein the airfoil sections are connected to the bearing surfaces of the transition pieces by rivets formed in a generally U-shaped rivet pattern.

6. The axial flow fan of claim 5 wherein the base of the rivet pattern is adjacent the hub of the fan.

7. The axial flow fan of claim 6 wherein the space between successive rivets is generally progressively reduced toward the base of the rivet pattern.

8. The axial flow fan of claim 1 wherein the transition pieces each comprise juxtaposed first and second pieces joined along a peripheral flange area.

9. A fan blade for an axial flow fan, comprising:

a hollow airfoil section comprising a sheet of alloy bent to form a leading edge and having a trailing edge formed from the joining of two long edges of the sheet, each of the long edges having a substantially continuously changing curvature, the sheet possessing a bend of a first direction adjacent one of the two long edges and a bend of a second direction adjacent the other of the two long edges, whereby the airfoil section possesses a twist; and a transition piece having first and second airfoil bearing surfaces, substantially all of the bearing surfaces being in contact with an interior surface of the airfoil section, and wherein each of the bearing surfaces after joining to the airfoil section possesses a twist complementary to the twist of the airfoil section.

10. The fan blade of claim 9 wherein the alloy is aluminum.

11. The fan blade of claim 9 wherein the airfoil section is tapered.

12. The fan blade of claim 9 wherein the airfoil section and the transition piece are aluminum.

13. The fan blade of claim 9 wherein the airfoil section is connected to the bearing surfaces of the transition pieces by rivets formed in a generally U-shaped rivet pattern.

14. The fan blade of claim 13 wherein the base of the rivet pattern is adjacent the hub of the fan.

15. The fan blade of claim 14 wherein the space between successive rivets is generally progressively reduced toward the base of the rivet pattern.

16. The fan blade of claim 9 wherein the transition piece comprises juxtaposed first and second pieces joined along a peripheral flange area.

17. A fan blade for an axial flow fan, comprising:

a hollow airfoil section comprising a flat sheet of airfoil material shaped to form a leading edge and having a trailing edge formed from the joining of two long edges of the sheet, each of the long edges having a substantially continuously changing curvature, the sheet possessing a bend of a first direction adjacent one of the two long edges and a bend of a second direction adjacent the other of the two long edges, whereby the airfoil section possesses a twist; and a transition piece having first and second airfoil bearing surfaces, substantially all of the bearing surfaces being in contact with an interior surface of the airfoil section, and wherein each of the bearing surfaces after joining to the airfoil section possesses a twist complementary to the twist of the airfoil section.

18. The fan blade of claim 17 wherein the transition piece is generally rectangular having a root end provided with a sloping shoulder that narrows into a neck portion and wherein the transition length is 1.5–3.0 times the transition width.

19. The fan blade of claim 18 wherein the transition width is in a range of 30–70% of the width of the airfoil section.

20. The fan blade of claim 17 wherein the transition piece further comprises juxtaposed first and second pieces, each having a shallow dished interior surface, a generally straight tip end and a root end having a semicircular neck portion extending therefrom, joined by rivets along a peripheral flange.

21. The fan blade of claim 20 wherein the transition piece further comprises a collar having proximal and distal flanges secured between the neck portions of the first and second pieces.

22. A method of forming a true twisted airfoil section from a flat piece of alloy, comprising the steps of:

cutting the flat piece of light alloy to form a shaped pattern having two opposed long edges, each of the long edges having a substantially continuously changing curvature;

making a first bend adjacent one of the long edges to provide a curve in a first direction;

making a second bend adjacent the other of the long edges to provide a curve in a second direction;

making a third bend to join the long edges, the shaped pattern and bends resulting in a preselected twist; and securing the long edges together to form a trailing edge.

23. The method according to claim 22 wherein the alloy is aluminum.

24. The method according to claim 22 wherein the shaped pattern is tapered.

* * * * *